United States Patent [19]

Bryan

[11] Patent Number: 4,778,172

[45] Date of Patent: Oct. 18, 1988

[54] ANIMAL HEAD

[76] Inventor: William C. Bryan, 23139 Schumann Rd., Chatsworth, Calif. 91311

[21] Appl. No.: 72,971

[22] Filed: Jul. 14, 1987

[51] Int. Cl.[4] ..... A63J 3/00; A63H 3/36

[52] U.S. Cl. ..... 272/8 N; 446/26; 446/395

[58] Field of Search ..... 446/304, 369, 372, 371, 446/395, 391, 268, 26, 368, 901; 272/8 N, 8 R

[56] References Cited

U.S. PATENT DOCUMENTS

| | | | |
|---|---|---|---|
| 3,132,859 | 5/1964 | Braunhut | 272/8 N |
| 4,244,142 | 1/1981 | Crawford | 446/329 X |
| 4,257,610 | 3/1981 | Ptaszek et al. | 446/304 X |

*Primary Examiner*—Mickey Yu

*Attorney, Agent, or Firm*—Bogucki, Scherlacher, Mok & Roth

[57] ABSTRACT

An animal head suitable for attachment to a stuffed animal body is molded to form a thin shell and then filled with conforming foam rubber. The head defines open jaws that can fit around a wrist of a person and an elongated tongue that can be wrapped around the wrist and secured between the upper and lower jaws to serve as a carrying handle. By making the tongue flesh tone in color and providing a red coloration on a visible portion of the tongue, a novelty effect simulating blood dripping from a bite is achieved.

9 Claims, 2 Drawing Sheets

FIG.1
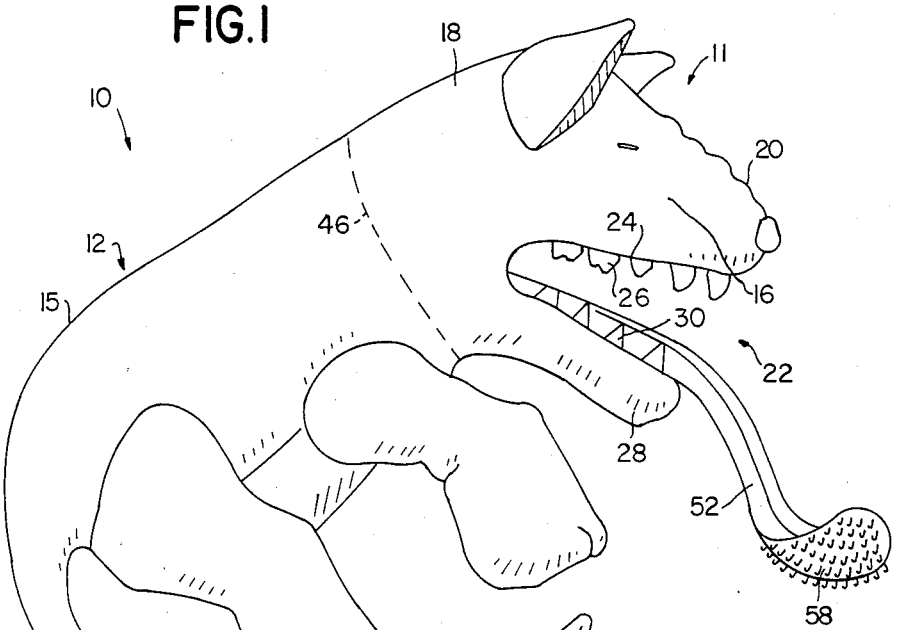
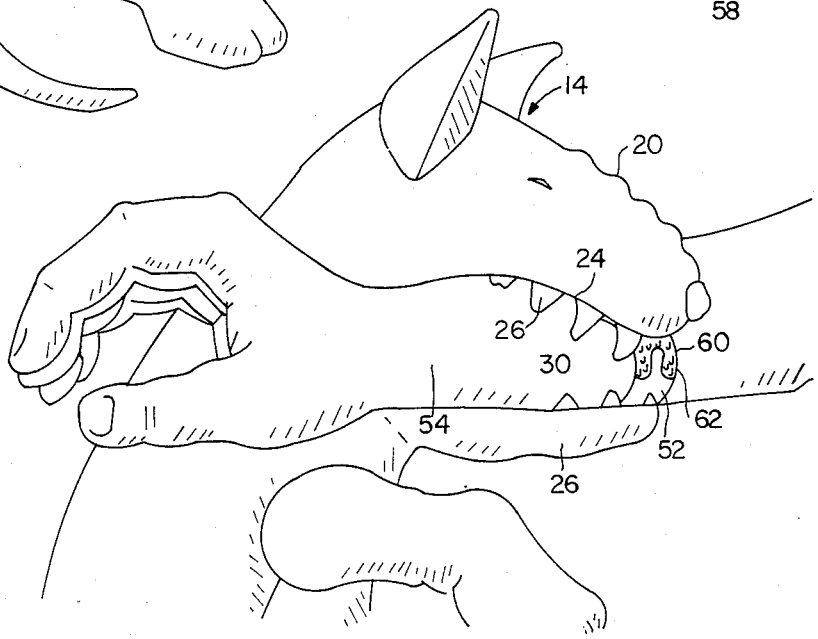
FIG.2

FIG. 3
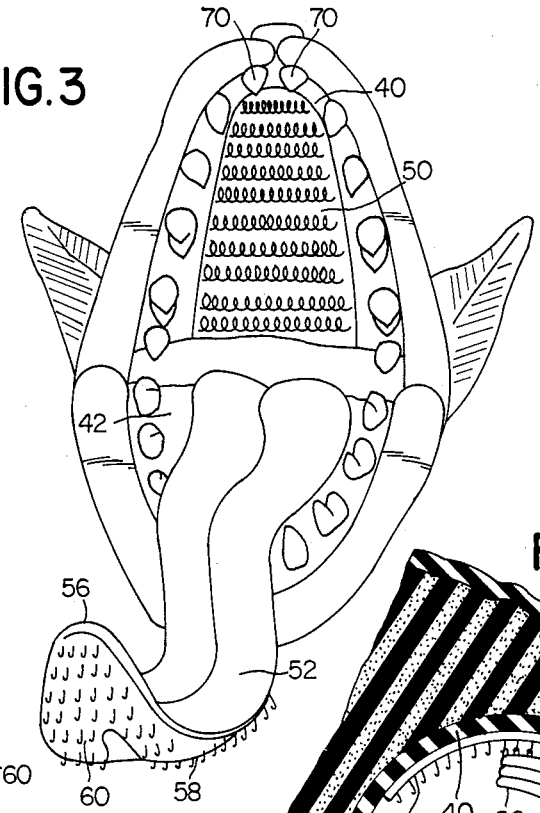
FIG. 5
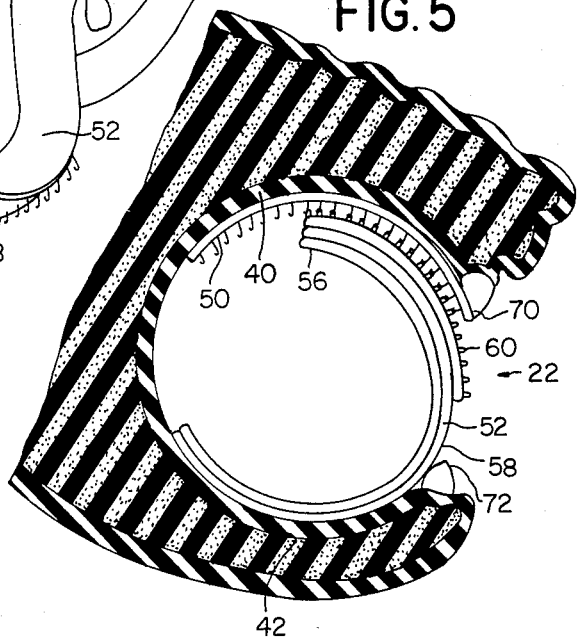
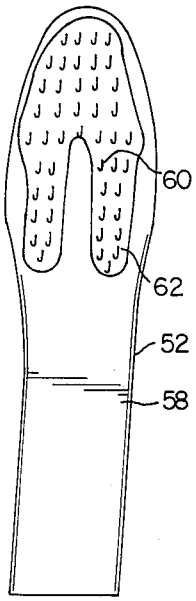
FIG. 4

ANIMAL HEAD

BACKGROUND OF THE INVENTION

Stuffed animals such as bears, dogs or other creatures are popular as toys and are particularly popular at entertainment centers such as carnivals or theme parks. However, carrying such toys around can be somewhat of a nuisance. Typically the carrying of such a toy restricts the freedom of the person to engage in other activities. It is therefore desirable to provide a means of enabling a person to carry the toy without restricting the use of the persons hands to the point of interfering with entertainment activities.

Animal heads have heretofore been provided with a variety of shapes and construction features. U.S. Pat. No. 1,324,730 to Cohen et al. teaches an animal head for attachment to fur scarfs and similar articles. It features a spring loaded, clamping jaws which may be used to secure the scarf to a wearer's clothing or to itself.

U.S. Pat. No. 4,268,918 teaches a novelty cap which is decorated to provide the appearance of an animal. U.S. Pat. No. 4,280,292 to Hills teaches an animal design in which a human operator may manipulate the jaws to simulate talking. U.S. Pat. No. 4,505,687 to Munro teaches a stuffed figure formed from a helical coil. The mouth does not appear to be hollow.

SUMMARY OF THE INVENTION

An animal head in accordance with the present invention includes a skull having formed thereon upper and lower jaws, teeth extending from the jaws, and an elongated tongue. The head may form the base for a stuffed toy such as a bear or dog.

The jaws are open or may be opened sufficiently to receive a human wrist and give the illusion of the head biting the wrist. At the same time the tongue may be wrapped around the wrist and used to releasably secure the head to the wrist. The tongue is preferably permanently bonded to the lower jaw and bears a fastener such as VELCRO hooks on the underneath side adjacent the free end.

Bonded to the upper jaw in the vicinity of the roof of the mouth is a mating fastener portion such as VELCRO eyes. The free end of the tongue may thus be passed around the wrist of the wearer and fastened to the top of the mouth. Not only does this provide a novelty illusion of the toy creature biting the wearer's wrist, but the toy remains secured to the wearer so that it can be carried without being held in the hands and interfering with the activities of the wearer.

The central frontal portions of the top and bottom jaws preferably have sloping surfaces that slope toward each other. This strengthens the bond between the tongue and the mouth by causing tension forces on the tongue to be directed generally parallel to the plane of the fastening surfaces. Coplanar directed forces are less likely to cause the tongue to become unfastened than normally directed forces.

To enhance this biting illusion the tongue may be constructed from a flesh colored fabric while the fastener portion on the underneath side of the tongue is red and shaped like dripping blood. This provides the illusion of blood dripping down the wrist from the bite of the animal.

BRIEF DESCRIPTION OF THE DRAWINGS

A better understanding of the invention may be had from a consideration of the following Detailed Description taken with the accompanying drawings in which:

FIG. 1 is a side view of an animal toy having an animal head in accordance with the invention;

FIG. 2 is a perspective view of the animal toy shown in FIG. 1 with the head secured to the wrist of a wearer;

FIG. 3 is a front view of an animal head in accordance with the invention;

FIG. 4 is a bottom view of the tongue illustrating the manner in which the fastener may be used to simulate dripping blood; and FIG. 5 is a sectional side view of an animal head in accordance with the invention illustrating the manner in which the tongue is secured to the upper and lower jaws.

DETAILED DESCRIPTION OF THE INVENTION

Referring now to FIGS. 1 and 2, there is shown a stuffed animal toy 10 including a conventional stuffed body portion 12 and a head portion 14 secured to the body portion 12 by a fabric covering 15 which helps define the body portion 12 and is secured to the head portion 14 by adhesive or other suitable means. The head portion 14 is preferably formed from a relatively thin molded shell 16 of a flexible material such as rubber. The shell 16 defines a skull 18, snout 20, open mouth 22 with upper jaw 24 having teeth 26 and lower jaws 28 having teeth 30.

As further shown in FIGS. 3–5, the mouth 22 is further defined in the interior thereof by an upper plate 40 which defines the interior of the roof of the mouth and a lower plate 42 which defines the interior of the bottom of the mouth. The rubber shell 16 terminates at a neck region 46 and is advantageously filled with a single, integral mass of shape conforming foam rubber to provide stiffening and assure shape support.

The plate 40 in the roof of the mouth has adhered thereto one part 50 of a two-part fastener mechanism such as the wool portion of a VELCRO type fastener. The plate 42 in the bottom of the mouth has secured thereto by adhesive or other suitable means an elongated, flexible fabric tongue 52. The tongue 52 is secured to lower plate 42 at a rearward end of tongue 52 and is long enough to wrap around a person's wrist or forearm 54 with the outward end 56 overlapping the upper fastener 50.

Affixed to the outer end 56 of the tongue 52 on an underneath side 58 thereof is a second fastener portion 60 such as VELCRO hooks which matingly engage the first fastener portion 50 to secure the second fastener portion 60 thereto. To enhance the novelty effect of a bite the tongue is preferably a neutral flesh tone in color with the second fastener portion 60, a separate cloth layer or other means providing a red material 62 in the region between the open jaws that is visible against the wrist 54 to provide the illusion of blood dripping from the bite.

The strength of the bond between rwo fastener portions 50, 60 at the upper jaw and between the tongue 52 and plate 42 at the lower jaw is increased by shaping the anterior portions of the upper plate 40 and lower plate 42 such that they curve toward the center of the mouth and become almost flush with the tips 70, 72 of the upper and lower front teeth.

As the tongue 52 is wrapped about the wrist 54 and secured in place, the highest stress points of the securing bonds are at the anterior of the mouth adjacent the tips 70, 72 of the front teeth. By curving the plates 40, 42 from deeper within the mouth 22 toward the tips 70, 72 of the front teeth at the anterior portion thereof, the plates 40, 42 become substantially tangential to the tongue 52 at the high stress points when tongue 52 is wrapped about a wrist 54.

As a result of the substantially tangential orientation of plates 40, 42, the decoupling forces between fastener portion 50 and plate 40, between fastener portion 50 and fastener portion 60 and between plate 42 and tongue 52 are substantially parallel to the respective mating planar surfaces and the normal component of the forces between the mating surfaces is substantially reduced to provide a more secure adhesion between the mating surfaces. By shaping the mating surfaces to extend tangentially to the tongue as it wraps about a wrist 54, the dislocation forces tend to be distributed over the mating surfaces and there is less concentration of forces at the anterior-most portion of the joints between mating surfaces.

While there has been shown and described a particular embodiment of an animal head in accordance with the invention for the purpose of enabling a person of ordinary skill in the art to make and use the invention, it will be appreciated that the invention is not limited to the particular embodiment. Accordingly, it should be appreciated that any modifications, variations or equivalent arrangement within the scope of the accompanying claims should be considered to be within the scope of the invention.

What is claimed is:

1. An animal head comprising:

upper and lower jaws defining a mouth of an animal which may be open sufficiently to receive a wrist of a human being therebetween;

an elongated tongue having a fixed end affixed to the lower jaw and a free end opposite the fixed end;

a mating, releasable fastener set having a first part affixed to an underneath side of the tongue adjacent the free end and a second part affixed to the upper jaw at a roof portion of the mouth such that the tongue may wrap around a human wrist inserted into the mouth with the free end being fastened to the upper part of the mouth to secure the head to the wrist while providing an illusion of the wrist being bitten by the animal head.

2. An animal head according to claim 1 wherein teeth are formed upon the upper and lower jaws.

3. An animal head according to claim 1 wherein the fastener set comprises a hook and eye type of fastener with the part affixed to the tongue being red in color and shaped to simulate blood dripping from the wrist of the human.

4. An animal head according to claim 1 wherein the tongue is made of fabric of a flesh color selected to blend with the color of a human wrist about which it may be wrapped and the first part of the fastener is red in color to create an illusion of blood pouring on the wrist.

5. An animal head according to claim 1 wherein the head is defined by a thin rubber outline that defines open jaws with teeth extending therefrom, the thin rubber outline being filled with a resilient foam material.

6. An animal head according to claim 1 wherein a surface of the upper jaw which supports the second fastener part slopes downward toward the lower jaw such that a force exerted upon the second fastener part by the tongue when wrapped about a human wrist has a direction which is substantially in the plane of the surface.

7. An animal head according to claim 1 wherein a surface of the lower jaw to which the fixed end of the tongue is secured slopes upward toward the upper jaw such that when the tongue is wrapped about a wrist a pulling force exerted upon the lower jaw by the tongue is substantially in the plane of the surface.

8. An animal head for simulating biting of an object while securing the animal head to the object comprising upper and lower jaws that have teeth extending therefrom and may be open significantly to receive the object and create the illusion of biting the object, and a tongue adapted to be wrapped about the object with opposite ends secured to the upper and lower jaws.

9. An animal head comprising a skull portion defining upper and lower jaw portions having teeth extending therefrom, and an elongated tongue that is affixed to one of the jaws at a first end and releasably affixed to the other jaw at a second end opposite the first end.

* * * * *